US012679596B2

(12) United States Patent
Fuchs

(10) Patent No.: US 12,679,596 B2
(45) Date of Patent: Jul. 14, 2026

(54) MULTIPURPOSE CUP DEVICE

(71) Applicant: Carson Fuchs, Fort Myers, FL (US)

(72) Inventor: Carson Fuchs, Fort Myers, FL (US)

( * ) Notice: Subject to any disclaimer, the term of this patent is extended or adjusted under 35 U.S.C. 154(b) by 0 days.

(21) Appl. No.: 18/586,672

(22) Filed: Feb. 26, 2024

(65) Prior Publication Data

US 2025/0145333 A1 May 8, 2025

Related U.S. Application Data

(60) Provisional application No. 63/595,980, filed on Nov. 3, 2023.

(51) Int. Cl.

| | |
|---|---|
| ***A24F 23/00*** | (2006.01) |
| ***B65D 1/16*** | (2006.01) |
| ***B65D 25/04*** | (2006.01) |
| ***B65D 25/20*** | (2006.01) |
| ***B65D 47/12*** | (2006.01) |
| ***B65D 51/28*** | (2006.01) |

(52) U.S. Cl.

CPC ..... *B65D 25/04* (2013.01); *A24F 23/00* (2013.01); *B65D 1/16* (2013.01); *B65D 25/20* (2013.01); *B65D 47/12* (2013.01); *B65D 51/28* (2013.01)

(58) Field of Classification Search

CPC ..... B65D 25/04; B65D 51/28; A24F 23/00; A24F 23/04; A61J 19/00

USPC ..... 206/217, 256, 249; 4/259, 258; 131/231

See application file for complete search history.

(56) References Cited

U.S. PATENT DOCUMENTS

| | | | | | |
|---|---|---|---|---|---|
| 2,417,631 | A | | 3/1947 | Campos | |
| 2,562,666 | A | | 7/1951 | Gustafson | |
| 2,854,008 | A | | 9/1958 | Vieman | |
| 3,306,498 | A | | 2/1967 | Gonzalez | |
| 3,722,742 | A | | 3/1973 | Wertz | |
| 5,848,596 | A | * | 12/1998 | Zelenik | A24F 23/04 131/180 |
| 6,718,563 | B1 | * | 4/2004 | Kreiensieck | A61J 19/00 4/258 |
| 7,066,322 | B2 | * | 6/2006 | Wilson | A47G 19/22 206/217 |
| 7,416,078 | B2 | * | 8/2008 | Willis | B65D 83/02 206/217 |
| 7,739,755 | B2 | * | 6/2010 | Taras | A61J 19/00 4/258 |
| 8,408,390 | B2 | * | 4/2013 | Rennecamp | A24F 15/18 206/268 |
| 8,602,210 | B2 | * | 12/2013 | Milner | A24F 15/12 206/242 |
| 10,857,071 | B1 | * | 12/2020 | McClure | A61J 19/00 |

(Continued)

*Primary Examiner* — Steven A. Reynolds

(74) *Attorney, Agent, or Firm* — Brennan, Manna & Diamond, LLC

(57) ABSTRACT

A multipurpose cup device is provided. The device is comprised of a body with a liquid chamber for holding a drinking liquid which can be drank from a first opening in a lid of the device. The body may also be comprised of a spit chamber to collect spit through a second opening in the lid. Further, at least one tobacco/nicotine pouch can be placed in a pouch cartridge that can be placed within the body. After pressing a button on the cartridge, the cartridge feeds the pouch to and out of a dispensing structure located on the lid to allow a user to consciously remove the pouch and place it into their mouth.

10 Claims, 7 Drawing Sheets

(56) References Cited

U.S. PATENT DOCUMENTS

| | | | | |
|---|---|---|---|---|
| 2002/0175169 | A1* | 11/2002 | Tham-itthisak | A47G 19/2205<br>220/694 |
| 2006/0101564 | A1* | 5/2006 | Powdermaker | A61J 19/00<br>4/259 |
| 2017/0100308 | A1* | 4/2017 | Lampe | A61J 19/00 |
| 2025/0248444 | A1* | 8/2025 | Martin | B65D 83/04 |

* cited by examiner

MULTIPURPOSE CUP DEVICE

CROSS-REFERENCE TO RELATED APPLICATION

The present application claims priority to, and the benefit of, U.S. Provisional Application No. 63/595,980, which was filed on Nov. 3, 2023, and is incorporated herein by reference in its entirety.

FIELD OF THE INVENTION

The present invention relates generally to the field of cups. More specifically, the present invention relates to a multipurpose cup device that can function as a liquid drinking cup, a spitting cup, and a dispenser for tobacco/nicotine pouches. Accordingly, the present disclosure makes specific reference thereto. Nonetheless, it is to be appreciated that aspects of the present invention are also equally applicable to other like applications, devices, and methods of manufacture.

BACKGROUND

Utilizing nicotine and tobacco pouches often leads to a situation that can be uncomfortable and conspicuously noticeable, which is not an ideal scenario for the user. The act of removing said pouches from their packaging and placing them into a user's mouth can inadvertently become a focal point, drawing unwanted scrutiny from others in social or professional settings.

Moreover, there's an added inconvenience since said pouches frequently necessitate the need to expel saliva, compelling the user to have a receptacle at hand specifically for receiving said spit. This becomes particularly cumbersome as the individual must then carry around an additional container, often referred to as a 'spitting cup.' Managing this spitting cup becomes even more of a challenge when the user is already handling another cup from which they are drinking a beverage, leading to a juggling act of multiple containers that can be quite problematic and awkward to deal with in various situations.

Therefore, there exists a long-felt need in the art for dispensing nicotine/tobacco pouches. More specifically, there exists a long-felt need in the art for a multipurpose cup device that allows a user to conspicuously dispense tobacco/nicotine pouches. There also exists a long-felt need in the art for a multipurpose cup device that allows a user to conspicuously dispense tobacco/nicotine pouches while also collecting spit from the user. In addition, there exists a long-felt need in the art for a multipurpose cup device that allows a user to conspicuously dispense tobacco/nicotine pouches while also collecting spit from the user while eliminating the need to carry a separate spitting cup and drinking cup.

The subject matter disclosed and claimed herein, in one embodiment thereof, comprises a multipurpose cup device. The device is comprised of a body with a liquid chamber for holding a drinking liquid which can be drank from a first opening in a lid of the device. The body may also be comprised of a spit chamber to collect spit through a second opening in the lid. Further, at least one tobacco/nicotine pouch can be placed in a pouch cartridge that can be placed within the body. After pressing a button on the cartridge, the cartridge feeds the pouch to and out of a dispensing structure located on the lid to allow a user to consciously remove the pouch and place it into their mouth.

In this manner, the multipurpose cup device of the present invention accomplishes all the foregoing objectives and provides a device that allows a user to conspicuously dispense tobacco/nicotine pouches. Further, the device does so while also collecting spit from the user. In addition, the device also functions as a drinking cup.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multipurpose cup device comprised of a cup body with a spit chamber, a liquid chamber, and a pouch cartridge that stores tobacco/nicotine pouches that are dispensed from a dispensing structure of a lid of the device.

The body is comprised of a plurality of liquid-holding chambers, wherein one chamber can hold liquid that can be drunk through a first opening of a lid of the device. The body may also have at least one spit chamber that receives tobacco spit from a user through a second opening of the lid. In one embodiment, the spit chamber is integrally formed within the body. In another embodiment, the chamber is removable (for easy cleaning) and rests within at least one spit chamber receiving area within the body. In order to keep liquid within both chambers separate, the body may have at least one interior divider wall.

The body is also comprised of at least one pouch cartridge receiving area that receives at least one pouch cartridge that holds a plurality of tobacco/nicotine pouches. The cartridge feeds pouches to at least one pouch dispensing structure located on the lid.

The body is also comprised of a bottom compartment. The compartment preferably threadedly attaches to the body. The compartment has an interior storage area for storing pouches. The bottom surface of the compartment may also be comprised of at least one bottle opener.

The present invention is also comprised of a method of using the device. First, a device is provided comprised of (i) a body comprised of a liquid chamber, a spit chamber, and a pouch cartridge receiving area (ii) a pouch cartridge comprised of a spring, a latch, and a button (iii) a lid comprised of a first opening, a second opening, a pouch dispensing structure comprised of an opening, and a locking mechanism and (iv) a bottom compartment that attaches to the body, the bottom compartment comprised of a storage area and a bottle opener. Then, a user can fill the liquid chamber with a liquid and drink the liquid from the chamber. Then, a user can spit into the spit chamber via the second opening. Then, a user can place at least one tobacco/nicotine pouch into a pouch cartridge while depressing a spring of the cartridge and while engaging a latch to secure the pouch into the cartridge. Then, the cartridge can be placed into the pouch cartridge receiving area of the body. Next, a user can disengage the locking mechanism of the pouch dispensing structure. Finally, a user can press a button on the cartridge to release a pouch from the cartridge and out an opening of the dispensing structure, wherein the pouch can be grabbed from the opening via a user's hand/mouth.

Accordingly, the multipurpose cup device of the present invention is particularly advantageous as it provides a device that allows a user to conspicuously dispense tobacco/nicotine pouches. Further, the device does so while also collecting spit from the user. In addition, the device also functions as a drinking cup. In this manner, the multipurpose cup device overcomes the limitations of existing methods, devices, and problems with using tobacco/nicotine pouches known in the art.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
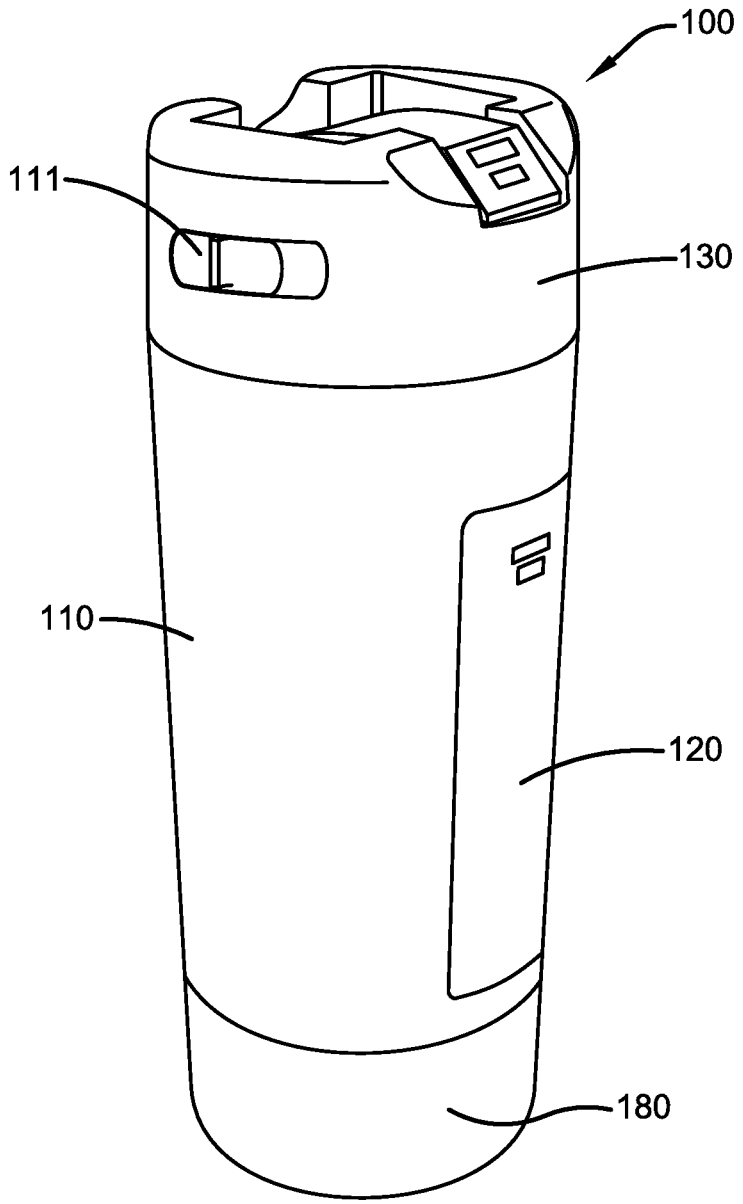
FIG. 1 illustrates a perspective view of one potential embodiment of a multipurpose cup device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for dispensing nicotine/tobacco pouches. More specifically, there exists a long-felt need in the art for a multipurpose cup device that allows a user to conspicuously dispense tobacco/nicotine pouches. There also exists a long-felt need in the art for a multipurpose cup device that allows a user to conspicuously dispense tobacco/nicotine pouches while also collecting spit from the user. In addition, there exists a long-felt need in the art for a multipurpose cup device that allows a user to conspicuously dispense tobacco/nicotine pouches while also collecting spit from the user while eliminating the need to carry a separate spitting cup and drinking cup.

The present invention, in one exemplary embodiment, is comprised of a multipurpose cup device. The device is comprised of a cup body with a spit chamber, a liquid chamber, and a pouch cartridge that stores tobacco/nicotine pouches that are dispensed from a dispensing structure of a lid of the device.

The body is comprised of a plurality of liquid-holding chambers, wherein one chamber can hold liquid that can be drunk through a first opening of a lid of the device. The body may also have at least one spit chamber. This chamber receives tobacco spit from a user through a second opening of the lid. In one embodiment, the spit chamber is integrally formed within the body. In another embodiment, the chamber is removable (for easy cleaning) and rests within at least one spit chamber receiving area within the body. In order to keep liquid within both chambers separate, the body may have at least one interior divider wall.

The body is also comprised of at least one pouch cartridge receiving area that receives at least one pouch cartridge that holds a plurality of tobacco/nicotine pouches. The cartridge feeds pouches to at least one pouch dispensing structure located on the lid.

The body is also comprised of a bottom compartment. The compartment preferably threadedly attaches to the body. The compartment has an interior storage area for storing pouches. The bottom surface of the compartment may also be comprised of at least one bottle opener.

The present invention is also comprised of a method of using the device. First, a device is provided comprised of (i) a body comprised of a liquid chamber, a spit chamber, and a pouch cartridge receiving area (ii) a pouch cartridge comprised of a spring, a latch, and a button (iii) a lid comprised of a first opening, a second opening, a pouch dispensing structure comprised of an opening, and a locking mechanism and (iv) a bottom compartment that attaches to the body, the bottom compartment comprised of a storage area and a bottle opener. Then, a user can fill the liquid chamber with a liquid and drink the liquid from the chamber. Then, a user can spit into the spit chamber via the second opening. Then, a user can place at least one tobacco/nicotine pouch into a pouch cartridge while depressing a spring of the cartridge and while engaging a latch to secure the pouch into the cartridge. Then, the cartridge can be placed into the pouch cartridge receiving area of the body. Next, a user can disengage the locking mechanism of the pouch dispensing structure. Finally, a user can press a button on the cartridge to release a pouch from the cartridge and out an opening of the dispensing structure, wherein the pouch can be grabbed from the opening via a user's hand/mouth.

Accordingly, the multipurpose cup device of the present invention is particularly advantageous as it provides a device that allows a user to conspicuously dispense tobacco/nicotine pouches. Further, the device does so while also collecting spit from the user. In addition, the device also functions as a drinking cup. In this manner, the multipurpose cup device overcomes the limitations of existing methods, devices, and problems with using tobacco/nicotine pouches known in the art.

Referring initially to the drawings, FIG. 1 illustrates a perspective view of one potential embodiment of a multipurpose cup device 100 of the present invention in accordance with the disclosed architecture. The device 100 is comprised of a cup body 110 with a spit chamber 114, a liquid chamber 116, and a pouch cartridge 120 that stores tobacco/nicotine pouches that are dispensed from a dispensing structure 170 of a lid 130 of the device 100. The device 100 and all components are preferably made from a double-walled stainless steel material that may be vacuum scaled for insulation purposes. However, the device 100 may be made from any cup/tumbler material known in the art.

Figure 2:
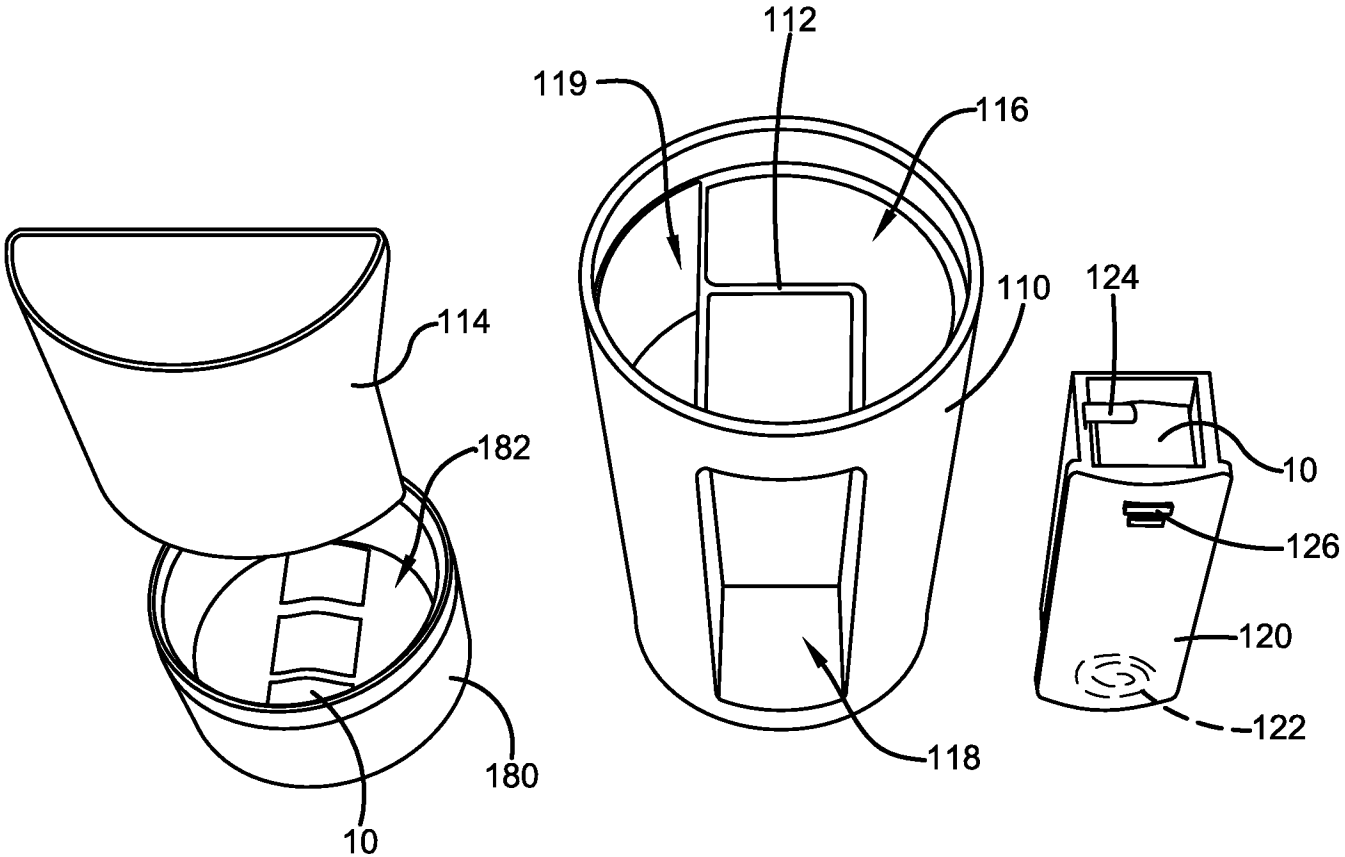
FIG. 2 illustrates an exploded view of the components of one potential embodiment of a multipurpose cup device of the present invention in accordance with the disclosed architecture.

The body 110 is comprised of a plurality of liquid-holding chambers, as seen in FIG. 2. In one embodiment, the body 110 is comprised of at least one liquid chamber 116. The chamber 116 can hold liquid that can be drunk through a first opening 140 of a lid 130 of the device 100. The body 110 may also have at least one spit chamber 114. The spit chamber receives tobacco spit from a user through a second opening 150 of the lid 130. In one embodiment, the chamber 114 is integrally formed within the body 110. In another embodiment, the chamber 114 is removable (for easy cleaning) and rests within at least one spit chamber receiving area 119 within the body 110. In either embodiment, the chamber 114 may be attached to the lid 130 in order to ensure spit does not travel into the liquid chamber 116, or may be unattached to the lid 130 and area 119. In order to keep liquid within both chambers 114, 116 separate, the body 110 may have at least one interior divider wall 112.

The body 110 is also comprised of at least one pouch cartridge receiving area 118. The area 118 receives at least one pouch cartridge 120. The cartridge 120 holds a plurality of tobacco/nicotine pouches 10. More specifically, the pouches 10 are stored within the cartridge 120 atop at least one spring 122. The pouches 10 are secured within the cartridge 120 (while the spring 122 is in compression) via at least one latch 124 that can be released by at least one button 126 of the cartridge 120.

The cartridge 120 feeds pouches 10 to at least one pouch dispensing structure 170 located on the lid 130. More specifically, the structure 170 is comprised of at least one opening 171 that allows at least one pouch 10 to exit the structure 170. To dispense a pouch 10 from the structure 170, a user must first release a locking mechanism 172 from the structure 170 to allow the structure to open. The mechanism 172 prevents inadvertent opening of the structure 170 when a pouch 10 is not desired to be dispensed. The mechanism 172 may be any type known in the art such as, but not limited to, a button, a latch, a clip, etc.

Figure 3:
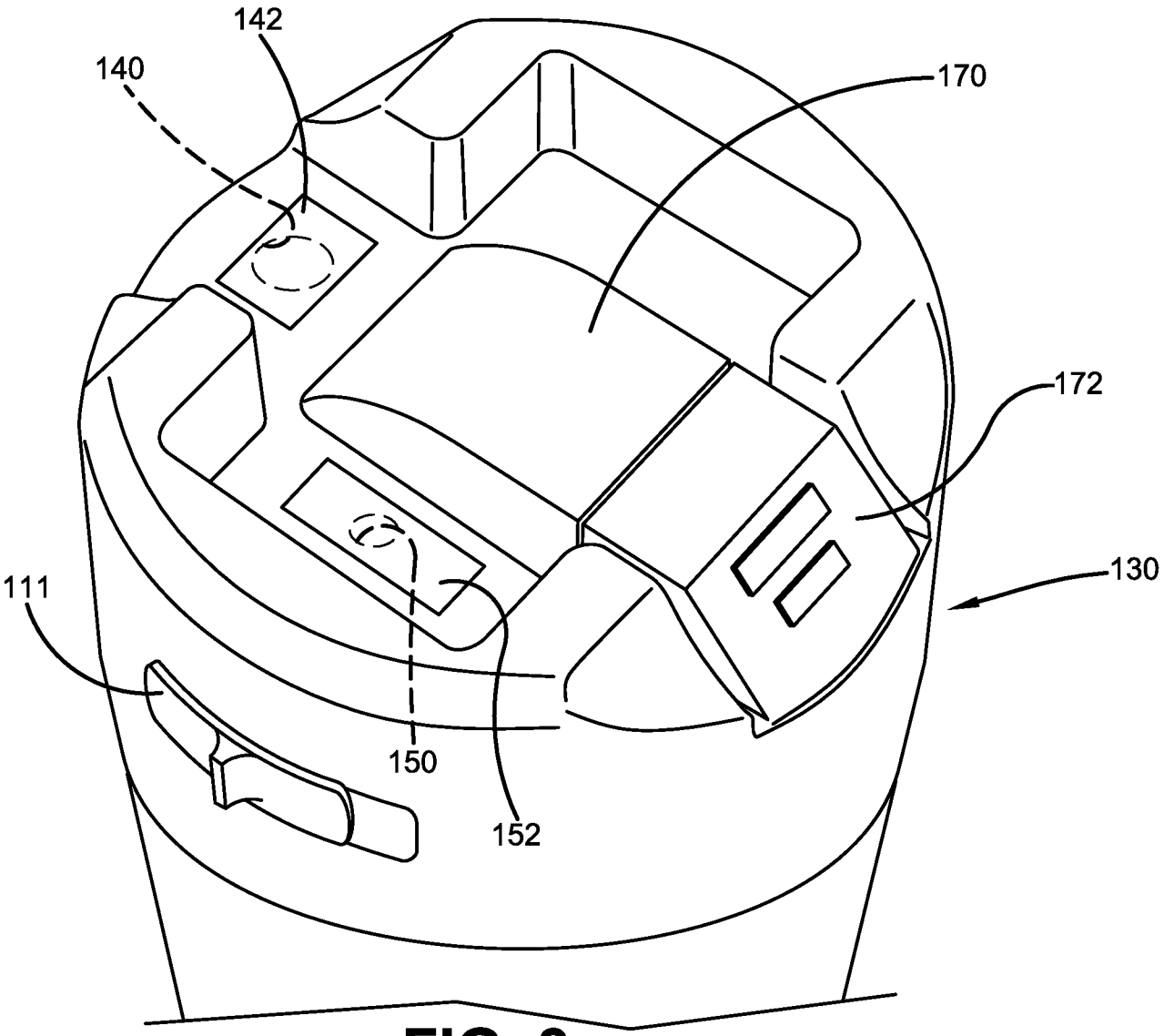
FIG. 3 illustrates an enhanced perspective view of a lid (with drinking openings and a dispensing structure closed) of one potential embodiment of a multipurpose cup device of the present invention in accordance with the disclosed architecture.
Figure 4:
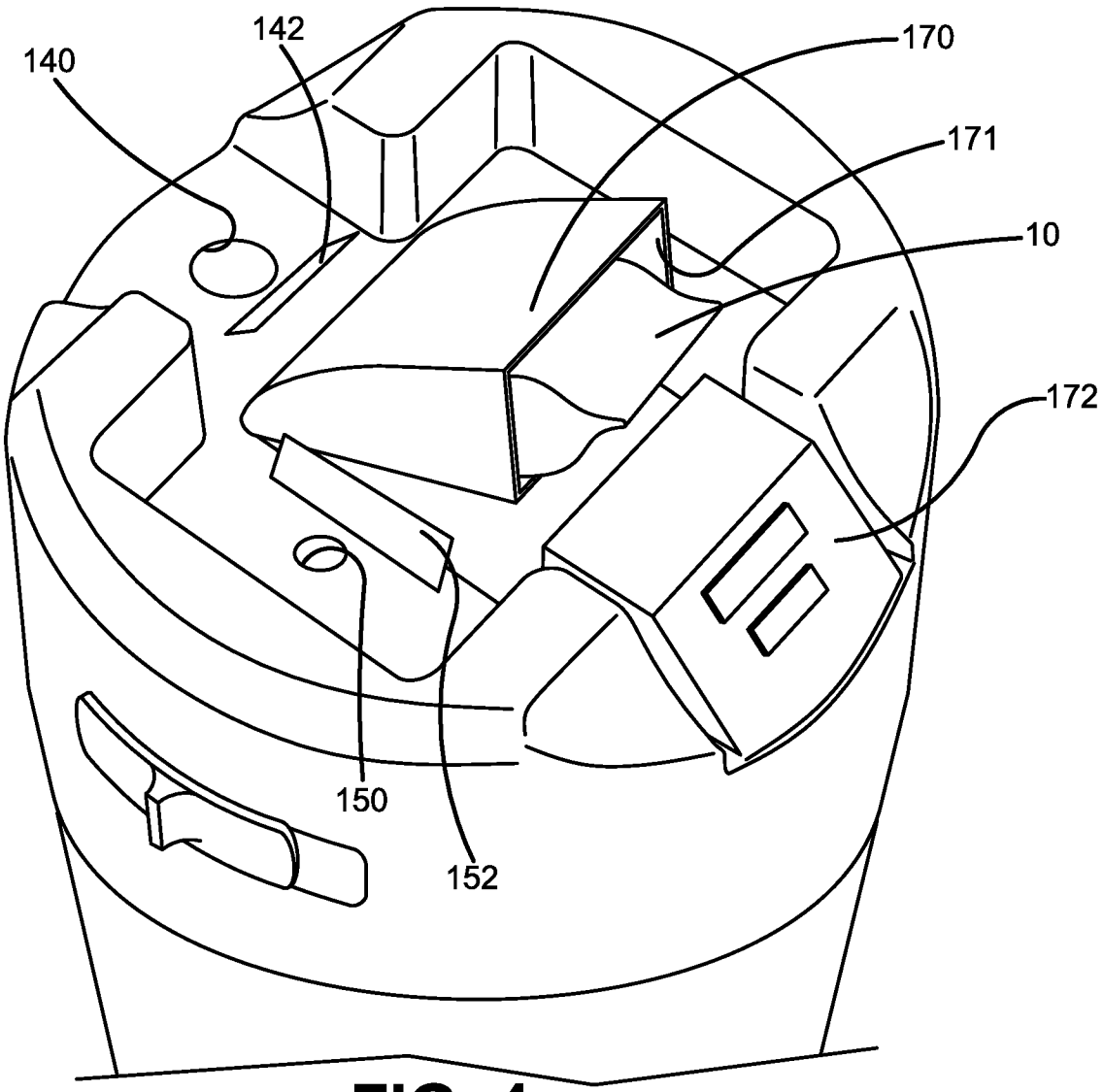
FIG. 4 illustrates an enhanced perspective view of a lid (with drinking openings and a dispensing structure open) of one potential embodiment of a multipurpose cup device of the present invention in accordance with the disclosed architecture.

Each opening 140, 150 (as seen in FIG. 3) of the lid 130 is also comprised of at least one lid 142, 152, as seen in FIG. 4. The lids 142, 152 prevent liquid from spilling out of the openings 140, 150 from each chamber 114, 116 that each opening 140, 150 is in fluid communication with. The openings 140, 150 may be any size and shape known in the art. The lids 142, 152 may be any lid types known in the art such as, but not limited to, a sliding lid, a hinged lid, a threaded lid, etc.

To further secure the lid 130 on the body 110, the lid 130 is comprised of at least one locking mechanism 111. The mechanism 111 secures the lid 130 from the body 110 and prevents the lid 130 from falling off the body 110 during use. In alternative embodiments of the device 100, the lid 130 and body 110 may attach via threads or other cup/tumbler fasteners known in the art.

Figure 5:
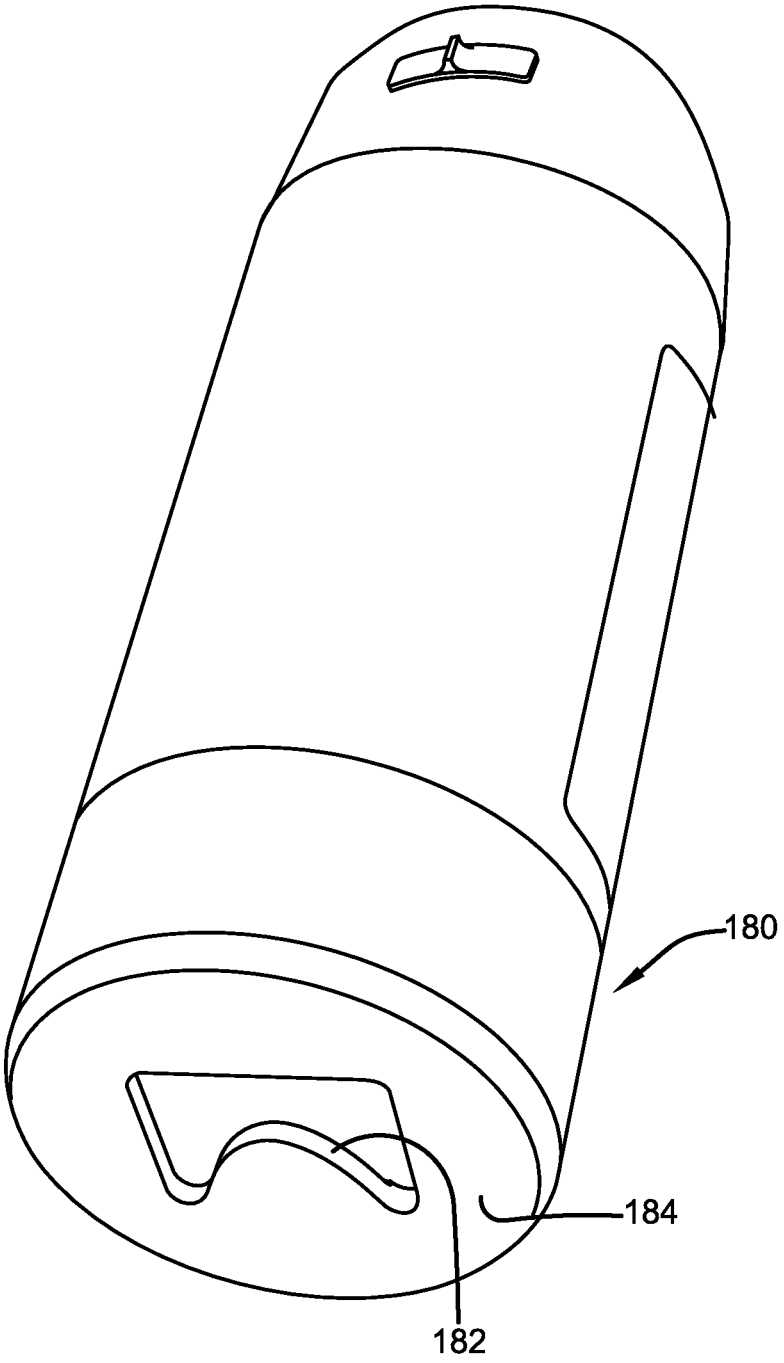
FIG. 5 illustrates a bottom perspective view of one potential embodiment of a multipurpose cup device of the present invention in accordance with the disclosed architecture.

The body 110 is also comprised of a bottom compartment 180. The compartment 180 preferably threadedly attaches to the body 110. The compartment 180 has an interior storage area 182 for storing pouches 10, as seen in FIG. 2. The bottom surface 184 of the compartment 180 may also be comprised of at least one bottle opener 186, of any type known in the art, as seen in FIG. 5

Figure 6:
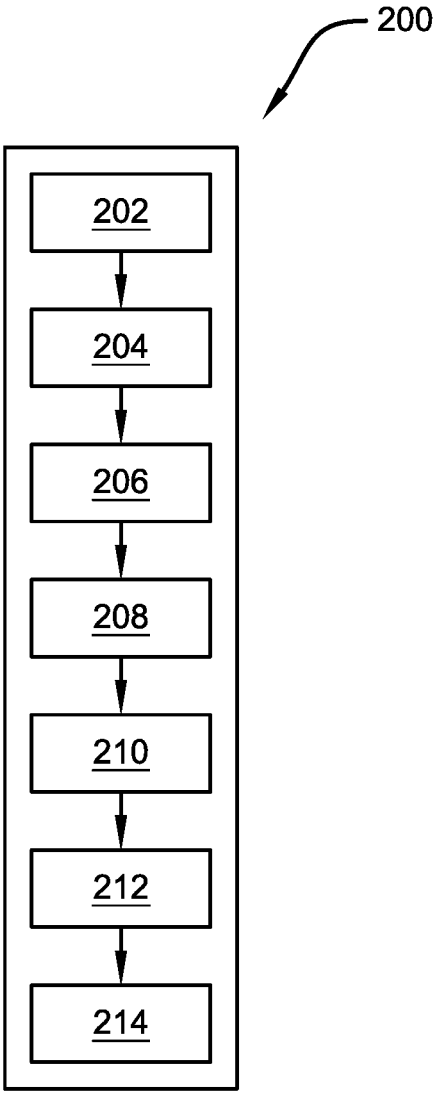
FIG. 6 illustrates a flowchart of a method of using one potential embodiment of a multipurpose cup device of the present invention in accordance with the disclosed architecture.

The present invention is also comprised of a method of using 200 the device 100, as seen in FIG. 6. First, a device 100 is provided comprised of (i) a body 110 comprised of a liquid chamber 116, a spit chamber 114, and a pouch cartridge receiving area 119 (ii) a pouch cartridge 120 comprised of a spring 122, a latch 124, and a button 126 (iii) a lid 130 comprised of a first opening 140, a second opening 150, a pouch dispensing structure 170 comprised of an opening 171, and a locking mechanism 172 and (iv) a bottom compartment 180 that attaches to the body 110, the bottom compartment 180 comprised of a storage area 182 and a bottle opener 186 [Step 202]. Then, a user can fill the liquid chamber 116 with a liquid and drink the liquid from the chamber 116 via the opening 140 [Step 204]. Then, a user can spit into the spit chamber 114 via the second opening 150 [Step 206]. Then, a user can place at least one tobacco/nicotine pouch 10 into a pouch cartridge 120 while depressing a spring 122 of the cartridge 120 and while engaging a latch 124 to secure the pouch 10 into the cartridge 120 [Step 208]. Then, the cartridge 120 can be placed into the pouch cartridge receiving area 119 of the body 110 [Step 210]. Next, a user can disengage the locking mechanism 172 of the pouch dispensing structure 170 [Step 212]. Finally, a user can press a button 126 on the cartridge 120 to release a pouch 10 from the cartridge 120 and out an opening 171 of the dispensing structure 170, wherein the pouch 10 can be grabbed from the opening 171 via a user's hand/mouth [Step 214].

Figure 7:
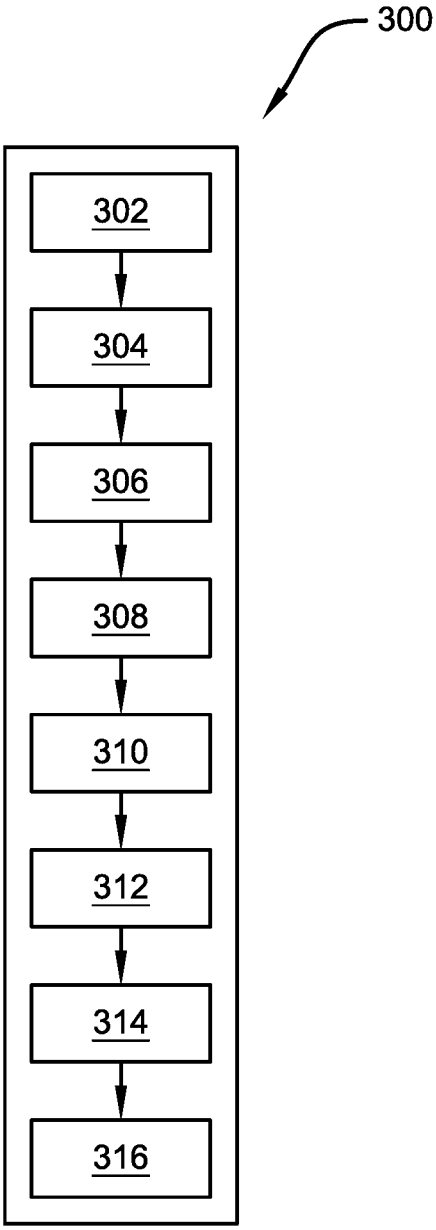
FIG. 7 illustrates a flowchart of a method of using one potential embodiment of a multipurpose cup device of the present invention in accordance with the disclosed architecture.

The present invention is also comprised of a method of using 300 the device 100, as seen in FIG. 7. First, a device 100 is provided comprised of (i) a body 110 comprised of a liquid chamber 116 and a pouch cartridge receiving area 119 (ii) a pouch cartridge 120 comprised of a spring 122, a latch 124, and a button 126 (iii) a lid 130 comprised of a first opening 140, a second opening 150, a pouch dispensing structure 170 comprised of an opening 171, a locking mechanism 172, and a spit chamber 114 attached to the lid 130 and (iv) a bottom compartment 180 that attaches to the body 110, the bottom compartment 180 comprised of a storage area 182 and a bottle opener 186 [Step 302]. Then, a user can fill the liquid chamber 116 with a liquid and drink the liquid from the chamber 116 via the opening 140 [Step 304]. Then, a user can spit into the spit chamber 114 via the second opening 150 [Step 306]. Then, a user can place at least one tobacco/nicotine pouch 10 into a pouch cartridge 120 while depressing a spring 122 of the cartridge 120 and while engaging a latch 124 to secure the pouch 10 into the cartridge 120 [Step 308]. Then, the cartridge 120 can be placed into the pouch cartridge receiving area 119 of the body 110 [Step 310]. Next, a user can disengage the locking mechanism 172 of the pouch dispensing structure 170 [Step 312]. Finally, a user can press a button 126 on the cartridge 120 to release a pouch 10 from the cartridge 120 and out an opening 171 of the dispensing structure 170, wherein the pouch 10 can be grabbed from the opening 171 via a user's hand/mouth [Step 314]. A user can also remove the spit chamber 114 from the lid 130 as needed to dispose of spit and/or clean the chamber 114 [Step 316].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "multipurpose cup device" and "device" are interchangeable and refer to the multipurpose cup device 100 of the present invention.

Notwithstanding the foregoing, the multipurpose cup device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the multipurpose cup device 100 as shown in the FIGURES are for illustrative purposes only, and that many other sizes and shapes of the multipurpose cup device 100 are well within the scope of the present disclosure. Although the dimensions of the multipurpose cup device 100 are important design parameters for user convenience, the multipurpose cup device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A multipurpose cup device comprising:

a body comprised of a spit chamber, a liquid chamber, and a pouch cartridge receiving area;

a pouch cartridge comprised of a spring, a latch, and a button;

a lid comprised of a first opening, a second opening, a pouch-dispensing structure comprised of a third opening, and a locking mechanism; and a bottom compartment comprised of a storage area and a bottle opener;

wherein the body is a double-walled, vacuum sealed, stainless-steel body; and further wherein the pouch cartridge is removably retained within the pouch cartridge receiving area of the body.

2. The multipurpose cup device of claim 1, wherein the first opening is comprised of a first lid.

3. The multipurpose cup device of claim 1, wherein the second opening is comprised of a second lid.

4. The multipurpose cup device of claim 1, wherein the bottle opener is positioned on a bottom surface of the bottom compartment.

5. The multipurpose cup device of claim 1, wherein the lid is secured to the body via a lid locking mechanism.

6. The multipurpose cup device of claim 1, wherein the spit chamber and the liquid chamber are separated by a divider wall.

7. A multipurpose cup device comprising:

a body comprised of a spit chamber receiving area, a liquid chamber, and a pouch cartridge receiving area;

a pouch cartridge comprised of a spring, a latch, and a button;

a spit chamber removably retained within the spit chamber receiving area of the body;

a lid comprised of a first opening, a second opening, a pouch-dispensing structure comprised of a third opening, and a locking mechanism, and a spit chamber; and a bottom compartment comprised of a storage area and a bottle opener;

wherein the pouch cartridge is removably retained within the pouch cartridge receiving area of the body.

8. The multipurpose cup device of claim 7, wherein the spit chamber removably attaches to the lid.

9. The multipurpose cup device of claim 7, wherein the bottom compartment removably attaches to the body.

10. The multipurpose cup device of claim 7, wherein the spit chamber receiving area and the liquid chamber are separated by a divider wall.

* * * * *